US007874289B2

(12) United States Patent
Larsen

(10) Patent No.: US 7,874,289 B2
(45) Date of Patent: Jan. 25, 2011

(54) DOOR ASSEMBLY FOR A COOKING APPLIANCE

(75) Inventor: Christopher A. Larsen, Dorchester, MA (US)

(73) Assignee: Maytag Corporation, Benton Harbor, MI (US)

( * ) Notice: Subject to any disclaimer, the term of this patent is extended or adjusted under 35 U.S.C. 154(b) by 1447 days.

(21) Appl. No.: 11/091,392

(22) Filed: Mar. 29, 2005

(65) Prior Publication Data

US 2006/0219234 A1 Oct. 5, 2006

(51) Int. Cl.
*F24C 15/02* (2006.01)

(52) U.S. Cl. ..... 126/198; 126/21 R

(58) Field of Classification Search ..... 126/198, 126/200, 21 R; 52/171.1, 786
See application file for complete search history.

(56) References Cited

U.S. PATENT DOCUMENTS

| | | | | |
|---|---|---|---|---|
| 3,500,815 | A | 3/1970 | De Weese et al. | |
| 3,855,994 | A | 12/1974 | Evans et al. | |
| 3,889,100 | A | 6/1975 | Dills | |
| 4,023,554 | A | 5/1977 | Katona | |
| 4,041,930 | A | 8/1977 | Katona | |
| 4,084,572 | A | 4/1978 | Schettl et al. | |
| 4,253,286 | A | 3/1981 | Katona | |
| 5,107,821 | A * | 4/1992 | von Blanquet | 126/19 R |
| 5,387,258 | A | 2/1995 | Puricelli | |
| 5,433,189 | A | 7/1995 | Bales et al. | |
| 5,441,036 | A | 8/1995 | Mikalauskas, II et al. | |
| 5,562,090 | A | 10/1996 | Katz | |
| 5,881,710 | A | 3/1999 | Davis et al. | |
| 6,561,180 | B1 | 5/2003 | Austin et al. | |

* cited by examiner

*Primary Examiner*—Alfred Basichas
(74) *Attorney, Agent, or Firm*—Tara M. Hartman; John W. Morrison; Diederiks & Whitelaw PLC

(57) ABSTRACT

A cooking appliance includes an oven door having a transparent zone and a passage for permitting an air flow to pass through the door and into a cooling duct extending about an oven cavity. The door includes a panel having a front surface and a central opening in which is arranged an outer transparent pane. The passage separates the outer transparent pane from an inner window pack. The inner window pack includes first and second, substantially parallel window panes spaced one from the other to establish an inner dead air space. Preferably, the door includes an inner transparent pane that forms, with an outer transparent pane, an outer window pack which establishes an outer dead air space. The outer dead air space is positioned between upper and lower portions of the oven door that establish additional dead air spaces that form an overall uniform insulating layer for the door.

12 Claims, 3 Drawing Sheets

DOOR ASSEMBLY FOR A COOKING APPLIANCE

BACKGROUND OF THE INVENTION

1. Field of the Invention

The present invention pertains to the art of cooking appliances and, more particularly, to an oven door assembly having inner and outer insulating dead air spaces and a convection air passage.

2. Discussion of the Prior Art

Ovens and their general construction are well known. Typically, an oven includes a cooking cavity having an opening which is selectively closed by a pivotally mounted door assembly. Usually, ovens are of two general configurations, built-in units, i.e. built into cabinet or wall structure, or slide-in and free standing units generally combined with cooktops which are commonly referred to as oven ranges. The doors furnished with ovens can be composed of multiple components which can include a sealing panel, thermal insulation, a window, an intermediate panel, an outer panel, handles, hinges and, in some instances, a decorative face covering made of metal, glass or the like.

One important concern in connection with constructing an oven door is the need to ensure that a front or outer surface of the door is maintained at an acceptable temperature level throughout a cooking operation, as the front surface can be touched by a consumer. In an oven door that is not provided with a window or transparent zone for visually inspecting the contents of an oven cavity, a significant amount of room exists for insulation material. Therefore, under these circumstances, the front surface can be readily prevented from excessive heating. When a window or, more accurately, window panes are provided in the door, the space available for insulation is significantly reduced. In addition, incorporating window panes into an oven door will necessarily increase an overall thickness of the door as space must be provided for a thermal insulation barrier. Regardless, excessive heating of the front surface of the door must still be considered and prevented.

Based on the above, there exists a need in the art for an effective and economical window containing oven door construction wherein the front surface of the oven door does not overheat during operation of the oven, particularly during high temperature operations, such as self-cleaning cycles. More specifically, there exists a need for an oven door that incorporates various dead air spaces between a cooling air passage and the front surface of the oven door to minimize heat transfer while maintaining a generally thin profile.

SUMMARY OF THE INVENTION

The present invention is directed to an oven door including a transparent zone, a plurality of dead air spaces and a passage for permitting a convective air flow to pass through the door so as to reduce the temperature on a front surface of the oven door by providing a uniform insulating barrier between the oven cavity and the front surface. Specifically, the door includes a front panel having an outer or front surface and a central opening in which is arranged an outer transparent pane. In addition to the outer transparent pane, the door is provided with an inner window pack. In accordance with the invention, the inner window pack is separated from the outer transparent pane by the passage. The window pack preferably includes first and second, substantially parallel window panes that are spaced one from the other to establish an inner dead air space.

In addition to the inner window pack, the most preferred form of the invention actually provides the door with inner and outer transparent panes that form an outer window pack. More specifically, the inner and outer transparent panes of the outer window pack are spaced from and substantially parallel to one another so as to establish an outer dead air space. In addition to the insulation provided by the inner and outer window packs, further insulation is provided by upper and lower dead air spaces that are positioned above and below the outer window pack. With this construction, a uniform insulating layer that extends from a top portion to a bottom portion of the front panel is established. The uniform insulating layer, in combination with the inner dead air spaces, establishes an overall thermal barrier that minimizes heat transfer from the oven cavity to the front surface of the door. In accordance with the invention, the convective air flow through the passage contributes to an overall cooling air flow which is directed about the oven cavity and then exhausted.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
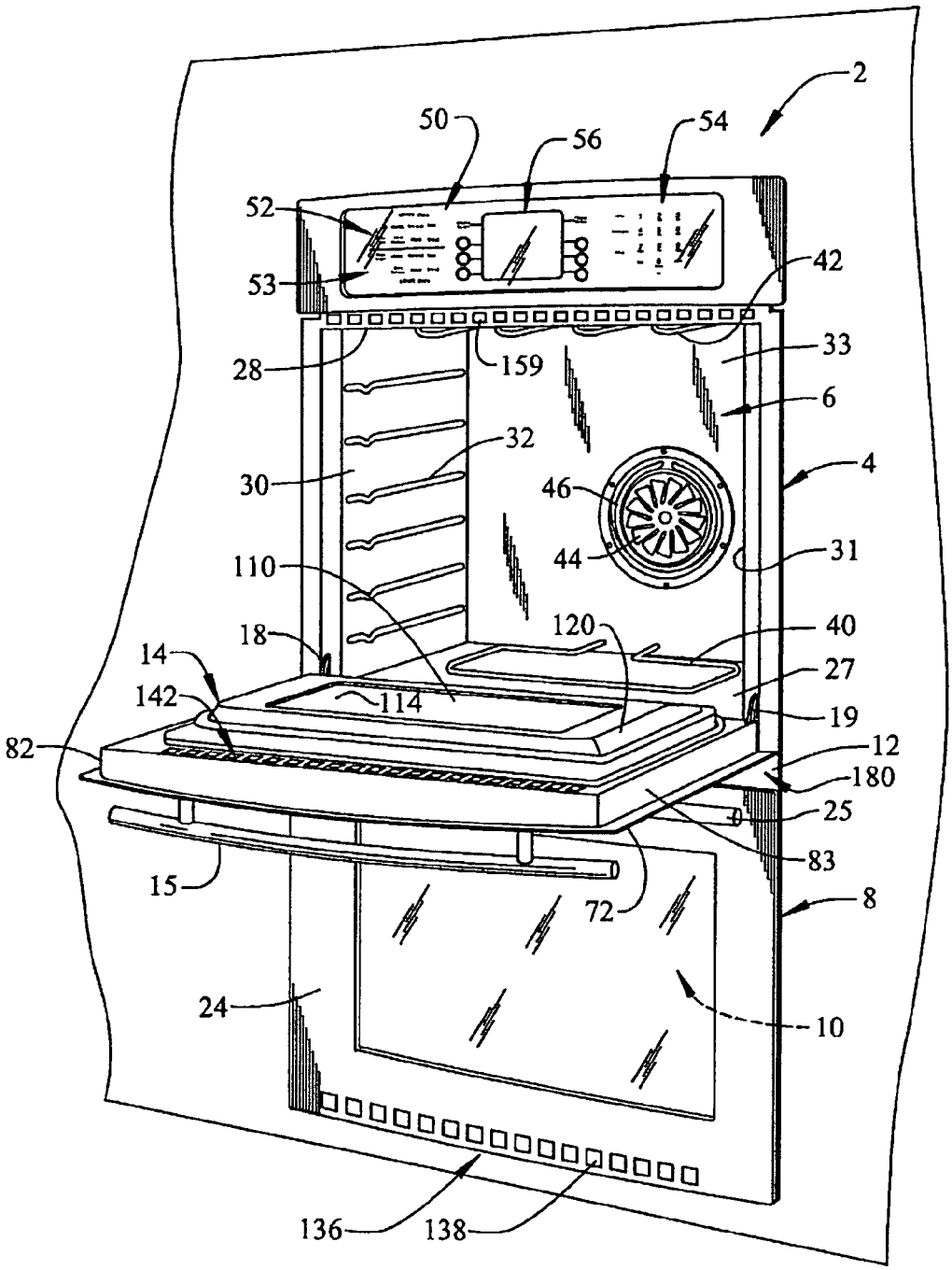
FIG. 1 is a perspective view of a wall oven employing a door assembly constructed in accordance with the present invention.

With initial reference to FIG. 1, a cooking appliance constructed in accordance with the present invention is generally indicated at 2. Cooking appliance 2, as depicted, constitutes a double wall oven. However, it should be understood that the present invention is not limited to this model type and can be incorporated into various types of oven configurations, e.g., cabinet mounted ovens, as well as both slide-in and free standing ranges. In any event, in the embodiment shown, cooking appliance 2 constitutes a dual oven wall unit including an upper oven 4 having upper oven cavity 6 and a lower oven 8 having a lower oven cavity 10. Cooking appliance 2 includes an outer frame 12 for supporting both upper and lower oven cavities 6 and 10 within, for example, a wall (not separately labeled).

Cooking appliance 2 includes a door assembly 14 to selectively provide access to upper oven cavity 6. As shown, door assembly 14 includes a handle 15 that enables a consumer to grasp and pivot door assembly 14 about a substantially horizontal axis, defined by hinges 18 and 19, to access oven cavity 6. In the embodiment shown, lower oven 8 is provided with a correspondingly constructed door assembly 24 that includes a handle 25 for selectively accessing lower oven cavity 10.

As further illustrated in FIG. 1, oven cavity 6 is defined by a bottom wall 27, an upper wall 28, opposing side walls 30 and 31 that, in a manner known in the art, are provided with a plurality of vertically spaced side rails such as indicated at 32, and a rear wall 33. In the embodiment shown, arranged above bottom wall 27 is an electric heating or bake element 40. At this point, it should be noted that bake element 40 could also be mounted below a false bottom of oven cavity 6. Also, a top broiler element 42 is arranged along upper wall 28 of oven cavity 6. Top broiler element 42 is selectively operated during an initial pre-heat period, during grilling operations in upper oven 4 and also to aid in pyrolytic heating during a self-clean operation. In any event, as shown, both bake element 40 and top broiler element 42 are constituted by sheathed electric resistive heating elements.

In the embodiment shown, cooking appliance 2 actually constitutes an electric, dual wall oven. However, it is to be understood that cooking appliance 2 could also operate on gas, either natural or propane, as well as a gas/electric combination. In any case, at least oven cavity 6 preferably employs both radiant and convection heating techniques for cooking food items therein. To this end, rear wall 33 is shown to include a convection fan or blower 44. Although the exact position and construction of fan 44 can readily vary in accordance with the invention, fan 44 draws in air through a central intake zone of a fan cover (not shown) and thereafter directs the air back into oven cavity 6 in radial outward directions. In addition, a portion of the air is exhausted from oven cavity 6 through an exhaust vent (not shown). Also as clearly shown in this figure, another sheathed electric heating element 46, which preferably takes the general form of a ring, extends circumferentially about fan 44 in order to heat the radially expelled air flow.

As still further shown in FIG. 1, cooking appliance 2 includes an upper control panel 50 having a plurality of control elements. In accordance with the embodiment shown, the control elements are constituted by first and second sets of oven control buttons 52 and 53, as well as a numeric pad 54. Control panel 50 is adapted to be used to input desired cooking parameters, as well as input initial operating conditions for cooking appliance 2. More specifically, the first and second sets of control buttons 52 and 53, in combination with numeric pad 54 and a display 56, enable a user to establish particular cooking operations for upper and lower ovens 4 and 8 respectively. In general, the structure described above is provided for the sake of completeness and to enable a better understanding of the overall invention. Instead, the present invention is particularly directed to the overall construction and thermal resistive properties of door assemblies 14 and 24. However, as each door assembly 14, 24 is identically constructed, a detailed description will be made with respect to door assembly 14 with an understanding that door assembly 24 has corresponding structure.

Figure 2:
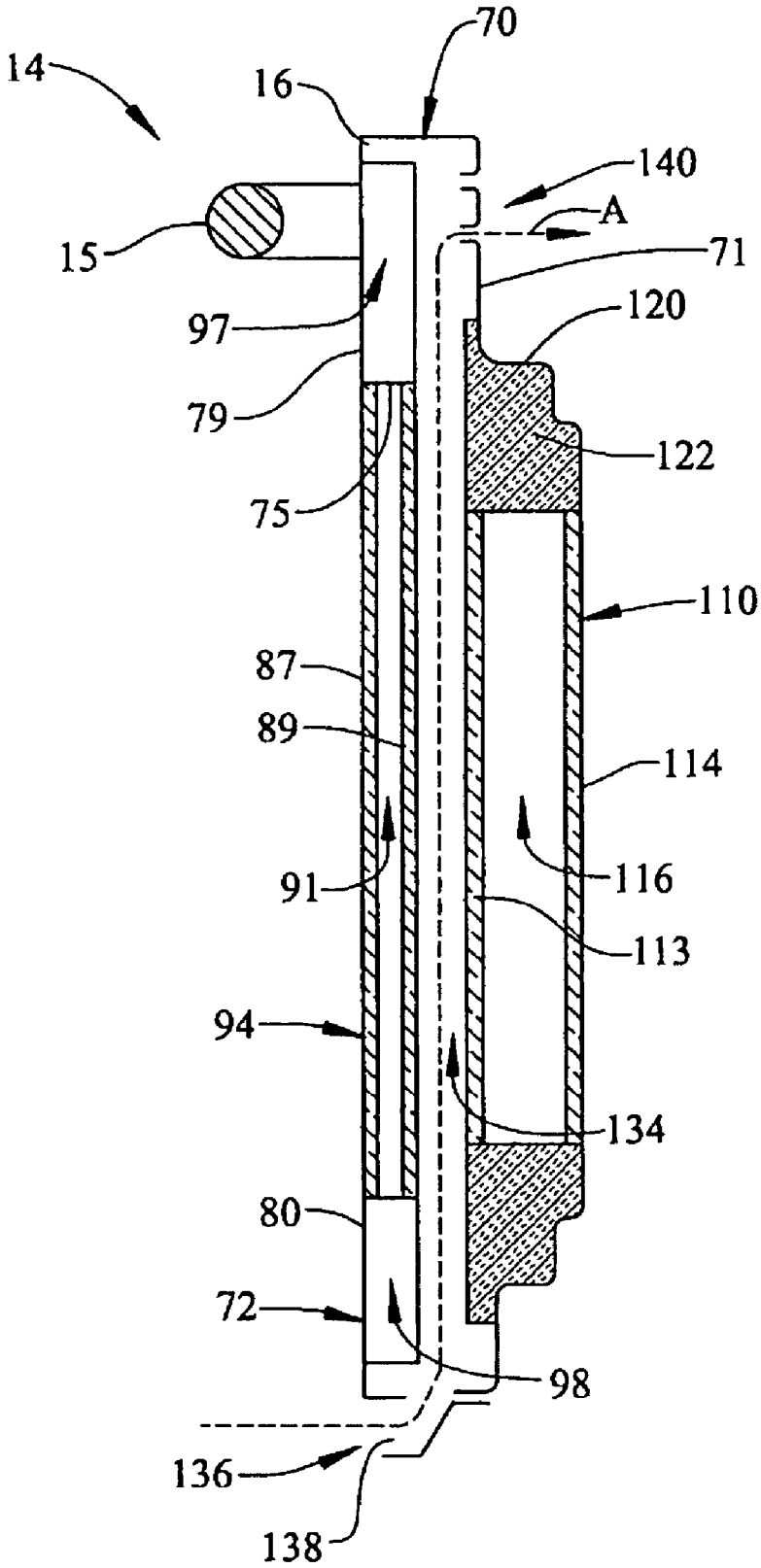
FIG. 2 is a cross-sectional, plan view of the door assembly constructed in accordance with the present invention.
Figure 3:
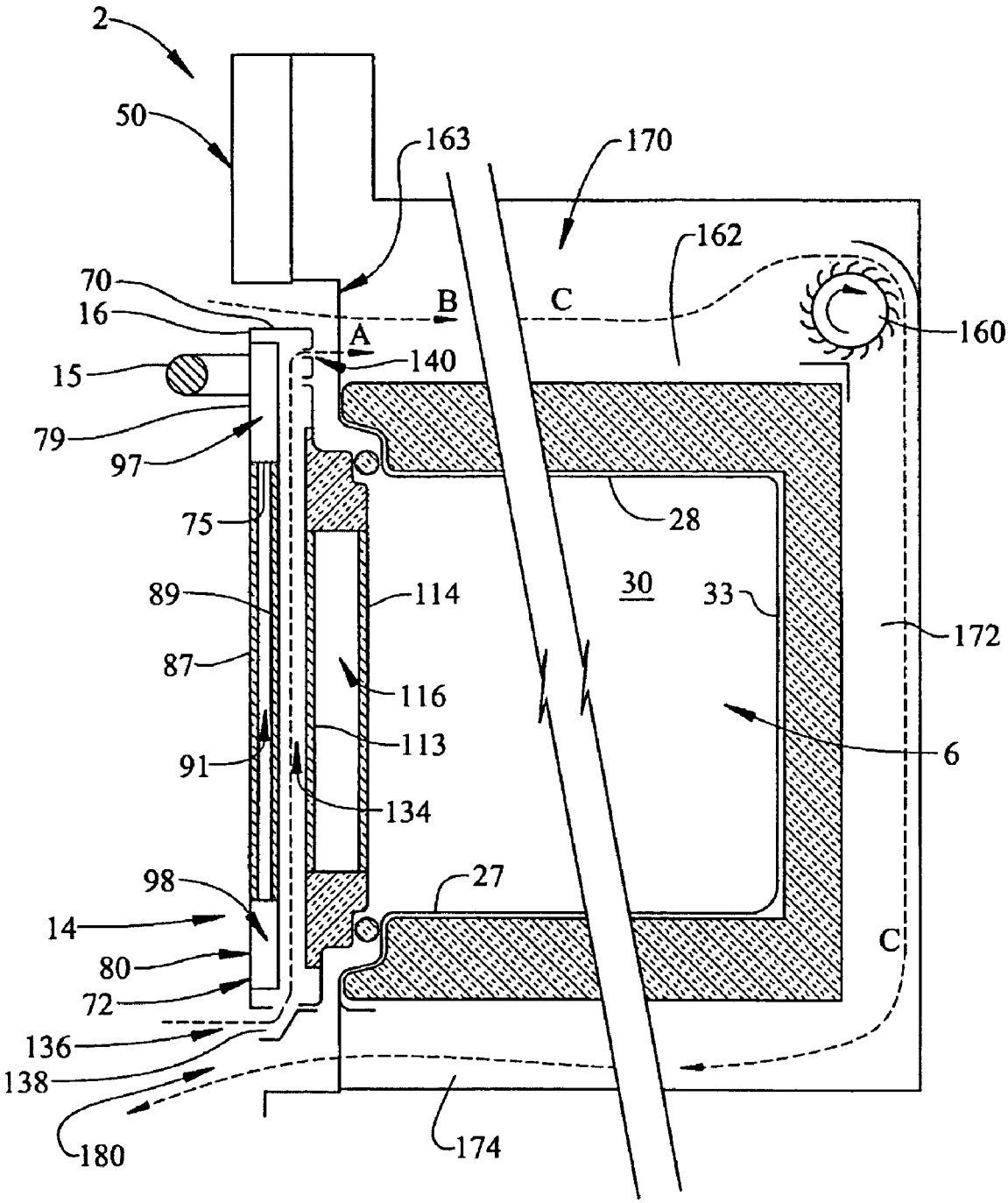
FIG. 3 is a cross-sectional, plan view of the wall oven and door assembly constructed in accordance with the present invention.

As best shown in FIGS. 2 and 3, door assembly 14 includes an outer door panel 70 and an inner door panel 71. Outer door panel 70 includes an outer face portion 72 that is provided with a central opening 75. As will be discussed more fully below, door assembly 14 includes an upper portion 79, a lower portion 80 and opposing side portions 82 and 83 (see FIG. 1). In accordance with the invention, door assembly 14 includes an outer transparent pane 87 that is positioned within central opening 75 of door panel 70. Spaced from outer transparent pane 87 is an inner transparent pane 89. As shown, inner transparent pane 89 is positioned so as to be substantially parallel to and spaced from outer transparent pane 87, thereby establishing an outer dead air space 91 that extends between upper portion 79 and lower portion 80. Actually, outer dead air space 91 also extends lengthwise across a majority of door assembly 14 between opposing side portions 82 and 83. In any event, outer transparent pane 87 and inner transparent pane 89 combine to form an outer window pack 94.

In accordance with the invention, upper portion 79 is basically defined by a closed box which establishes an upper dead air space 97. In a similar manner, lower portion 80 establishes a lower dead air space 98. In order to complete an overall thermal barrier, side portions 82 and 83 are provided with insulation material. In addition to outer window pack 94, door assembly 14 is provided with an inner window pack 110. In a manner similar to that described above, inner window pack 110 includes first and second panes 113 and 114 that are spaced from, and substantially parallel to, one another thereby establishing an inner dead air space 116. In the embodiment shown, inner window pack 110 is positioned within a raised portion 120 formed on inner door panel 71. Raised portion 120 is provided with insulation 122, preferably in the form of fiberglass, to further increase the overall thermal resistive properties of door assembly 14. As particularly shown in FIGS. 2 and 3, inner window pack 110 and outer window pack 94 are spaced from and preferably, substantially parallel to one another so as to establish a passage 134 that extends, as shown, vertically through door assembly 14.

In accordance with the most preferred form of the invention, passage 134 enables a natural or forced air flow A to pass through door assembly 14. Thus, passage 134 is provided with an inlet portion 136 defined by a plurality of vented openings 138. Air flow A entering into door assembly 14 through inlet portion 136 travels through passage 134 between both upper and lower dead air spaces 97 and 98, as well as outer and inner window packs 94 and 110, to an outlet portion 140 provided at upper portion 16 of door assembly 14. Actually, outlet portion 140 is constituted by a plurality of vented openings 142 (see FIG. 1) that cooperate with a corresponding plurality of openings 159 formed in cooking appliance 2 above oven cavity 6. In one preferred form of the invention, a centrifugal cooling fan or blower 160 is operated to establish the convective air flow A within door assembly 14 as discussed more fully below.

In further accordance with the most preferred form of the invention, the plurality of openings 159 lead into a duct 162 that extends across a top of oven cavity 6. Duct 162 has an inlet portion 163 defined, at least on part, by the plurality of openings 159 through which enters convection air flow A and ambient air flow B. Convective air flow A and ambient air flow B combine in an upper section 170 of duct 162. Upper section 170 leads to blower 160 and thereafter makes a substantially 90° bend to an aft section 172 that runs along a rear portion of oven cavity 6. At a point below bottom wall 27, duct 162 takes a second substantially 90° bend passing the combined air flow into a bottom section 174 positioned below oven cavity 6. Bottom portion 174 terminates at an exhaust outlet region 180 at which the combined air flow passes out of cooking appliance 2. Duct 162, together with passage 134, establishes an overall cooling air circuit.

With this overall arrangement, the air flow passing through passage 134 provides a cooling effect to door assembly 14, while also contributing to the overall air flow directed about oven cavity 6. At the same time, upper and lower dead air spaces 97 and 98 effectively operate to prevent heat generated within oven cavity 6 from passing outward and raising the surface temperature of outer panel 72 to unacceptable levels. Thus, it should be understood that the present invention allows a convection air flow to pass through door assembly 14 without permitting heat generated within oven 4 to elevate surface temperatures of door assembly 14. More specifically, given the relative positions of outer, upper lower and inner dead air spaces 91, 97, 98 and 116, a uniform insulation or thermal barrier is established that allows for the construction of a thin profile door having an outer surface that will remain cool to the touch.

Although described with reference to a preferred embodiment of the present invention, it should be readily apparent to one of ordinary skill in the art that various changes and/or modifications can be made to the invention without departing from the spirit thereof. For instance, while shown in connection with a double-wall oven, the present invention could be incorporated into other model types. In addition, the air inlet and outlet openings could take various forms in the upper and lower portions of the door. Finally, although a forced convection air flow system is described, a natural flow system could also be employed. In general, the invention is only intended to be limited to the scope of the following claims.

I claim:

1. A cooking appliance comprising:

an oven cavity having an frontal opening;

a control panel for selecting a desired cooking operation;

at least one heating element for heating the oven cavity based on the desired cooking operation; and a door assembly for selectively closing the frontal opening for the desired cooking operation, said door assembly including a door panel having an outermost surface provided with a central opening, an outer transparent pane arranged in the central opening, an inner transparent pane spaced from the outer transparent pane, said inner and outer transparent panes defining an outer dead air space therebetween, an upper dead air space arranged above the outer transparent pane, a lower dead air space arranged below the outer transparent pane and an inner window pack having first and second, substantially parallel window panes spaced one from the other to establish an inner dead air space, said inner window pack being spaced from the outer transparent pane so as to establish a passage, including an inlet portion arranged below the lower dead air space, for receiving a flow of ambient air that passes from outside the cooking appliance through the door assembly, wherein the upper, lower and inner dead air spaces, in combination with the passage, establish a thermal barrier so as to minimize heat transfer from the oven cavity to the outermost surface of the door panel.

2. The cooking appliance according to claim 1, wherein the inner transparent pane is arranged substantially parallel to the outer transparent pane.

3. The cooking appliance according to claim 1, wherein the outer transparent pane and the inner transparent pane constitute an outer window pack.

4. The cooking appliance according to claim 3, wherein the outer window pack is substantially parallel to the inner window pack.

5. The cooking appliance according to claim 1, wherein the cooking appliance constitutes a wall oven.

6. The cooking appliance according to claim 1, wherein the passage includes an outlet portion arranged directly behind the upper dead air space.

7. The cooking appliance according to claim 6, wherein the cooking appliance includes at least one inlet opening arranged above the oven cavity, said at least one inlet opening leading to a duct that extends about a portion of the oven cavity, said inlet portion of the passage being adapted to register with the at least one inlet opening such that a flow of air through the passage leads into the duct to establish a cooling air circuit.

8. The cooking appliance according to claim 7, further comprising: a blower arranged in the duct, said blower establishing a forced air convection air flow through the cooling air circuit.

9. A cooking appliance comprising:

an oven cavity having an frontal opening;

a control panel for selecting a desired cooking operation;

at least one heating element for heating the oven cavity based on the desired cooking operation; and a door assembly for selectively closing the frontal opening for the desired cooking operation, said door assembly including a door panel having an outermost surface provided with a central opening, an outer transparent pane arranged in the central opening, an inner transparent pane spaced from the outer transparent pane, said inner and outer transparent panes defining an outer dead air space therebetween, an upper dead air space arranged above the outer transparent pane, a lower dead air space arranged below the outer transparent pane, an inner window pack having first and second, substantially parallel window panes spaced one from the other to establish an inner dead air space, and insulation surrounding the inner window pack, said inner window pack being spaced from the outer transparent pane so as to establish a passage for receiving a flow of ambient air that passes from outside the cooking appliance through the door assembly, wherein the passage includes an inlet portion arranged below the lower dead air space, with the inlet portion being located between the insulation and the lower dead air space, and wherein the upper, lower and inner dead air spaces, in combination with the passage, establish a thermal barrier so as to minimize heat transfer from the oven cavity to the outermost surface of the door panel.

10. The cooking appliance according to claim 9, wherein the insulation is constituted by fiberglass.

11. A cooking appliance comprising:

an oven cavity having an frontal opening;

a control panel for selecting a desired cooking operation;

at least one heating element for heating the oven cavity based on the desired cooking operation;

a door assembly for selectively closing the frontal opening for the desired cooking operation, said door assembly including a door panel having an outermost surface provided with a central opening, an outer transparent pane arranged in the central opening and an inner window pack having first and second, substantially parallel window panes spaced one from the other to establish an inner dead air space, said inner window pack being spaced from the outer transparent pane so as to establish a passage for receiving a flow of ambient air that passes from outside the cooking appliance through the door assembly;

a cooling duct extending about a portion of the oven cavity;

at least one inlet opening arranged above the oven cavity and leading to the cooling duct, said inlet portion of the passage being adapted to register with the at least one inlet opening when the door assembly is closed such that a flow of air through the passage leads into the cooling duct; and at least one outlet opening arranged below the door assembly for exhausting the flow of air from the cooling duct.

12. The cooking appliance according to claim 11, wherein the door assembly further includes an upper dead air space arranged above the outer transparent pane, a lower dead air space arranged below the outer transparent pane, and an inner transparent pane arranged substantially parallel to and spaced from the outer transparent pane in the central opening, said inner and outer transparent panes defining an outer dead air space therebetween.

* * * * *